US005968718A

United States Patent [19]

Becher

[11] Patent Number: 5,968,718

[45] Date of Patent: Oct. 19, 1999

[54] COLOR DEVELOPMENT PROCESS THAT RESULTS IN HIGH OBSERVED SPEEDS

[75] Inventor: John H. Becher, Webster, N.Y.

[73] Assignee: Eastman Kodak Company, Rochester, N.Y.

[21] Appl. No.: 09/115,342

[22] Filed: Jul. 14, 1998

[51] Int. Cl.[6] ..... G03C 7/407

[52] U.S. Cl. ..... 430/383; 430/376; 430/963

[58] Field of Search ..... 430/376, 383, 430/963

[56] References Cited

U.S. PATENT DOCUMENTS

| | | | |
|---|---|---|---|
| 4,184,876 | 1/1980 | Eeles et al. | 430/505 |
| 4,439,520 | 3/1984 | Kofron et al. | 430/434 |
| 5,219,715 | 6/1993 | Sowinski et al. | 430/376 |

OTHER PUBLICATIONS

Research Disclosure, vol. 389, Sep. 1996, Item 38957, XI.
Research Disclosure, vol. 389, Sep. 1996, Item 38957, XVIII.
Research Disclosure, vol. 389, Sep., 1996, Item 38957, XIX.

*Primary Examiner*—Hoa Van Le
*Attorney, Agent, or Firm*—Carl O. Thomas

[57] ABSTRACT

A color negative photographic element is disclosed that is constructed with the following layer unit coating sequence, starting with the support: slower red, slower green, slower blue, faster red, faster green and faster blue. A surprising enhancement in speed is realized when color development is undertaken in a time (S) ranging from 15 to 110 seconds and a development temperature (T) ranging from 40 to 65° C., development time and temperature being chosen to satisfy the relationship:

$$(T)(\log S) \geqq 75.$$

12 Claims, No Drawings

COLOR DEVELOPMENT PROCESS THAT RESULTS IN HIGH OBSERVED SPEEDS

FIELD OF THE INVENTION

The invention relates to a development for color negative photographic elements. More specifically, the invention relates to a method of processing color negative elements containing silver halide emulsions and image dye-forming layer units.

DEFINITION OF TERMS

All references to silver halide grains and emulsions containing two or more halides name the halides in order of ascending concentrations.

In referring to grains, the term "ECD" indicates mean equivalent circular diameter and, in describing tabular grains, "t" indicates mean tabular grain thickness.

Tabular grains are those in which the aspect ratio, the ratio of ECD to t is at least 2.

Tabular grain emulsions are those in which tabular grains account for greater than 50 percent of total grain projected area.

Mean aspect ratio is defined as the average aspect ratio of tabular grains accounting for 50 percent of total grain projected area.

The tabularity, T, of a tabular grain is defined as the ratio ECD to $t^2$, both measured in micrometers ($\mu$m).

All coating coverages are in units of $g/m^2$, except as otherwise stated. Silver halide coating coverages are based on silver.

All percentages are percent by weight, based on total weight, except as otherwise stated.

In referring to blue, green and red recording layer units, the term "layer unit" indicates the hydrophilic colloid layer or layers that contain radiation-sensitive silver halide grains to capture exposing radiation and dye image-forming compound. The grains and dye image-forming compound are usually in the same layer or layers, but can be in adjacent layers.

The term "color negative element" refers to an element that contains a negative-working silver halide emulsion and undergoes a single development step to produce a dye image. The dye image produced in the single development step is usually a negative image, but it can be a positive dye image, depending upon the dye image providing compounds selected.

The term "E" is used to indicate exposure in lux-seconds.

A relative speed difference of 1 unit is equal to 0.01 log E.

The term "minus blue" refers to the visible spectrum at wavelengths longer than those of the blue region of the spectrum. Minus blue light is comprised of green light, red light or a combination of both.

In referring to processing times, primes (') are used to indicate minutes and double primes (") are used to indicate seconds.

The term "color developing agent" refers to a developing agent that reacts with an image dye-forming coupler to form an aromatic azomethine image dye.

The term "color developer" refers to a developer that contains a color developing agent.

The term "rapid processing" is employed to indicate completion of color development in less than 2 minutes.

*Research Disclosure* is published by Kenneth Mason Publications, Ltd., Dudley House, 12 North St., Emsworth, Hampshire P010 7DQ, England.

BACKGROUND

Color negative photographic elements are conventionally formed with superimposed red, green and blue recording layer units coated on a support. The red, green and blue recording layer units contain radiation-sensitive silver halide emulsions that form a latent image in response to red, green and blue light, respectively. Additionally, the red recording layer unit contains a cyan dye image-forming coupler, the green recording layer unit contains a magenta dye image-forming coupler, and the blue recording layer unit contains a yellow dye image-forming coupler. Following imagewise exposure, the color negative photographic elements are processed in a color developer, which contains a color developing agent that is oxidized while selectively reducing to silver latent image bearing silver halide grains. The oxidized color developing agent then reacts with the dye image-forming coupler in the vicinity of the developed grains to produce a dye image. Cyan (red-absorbing), magenta (green-absorbing) and yellow (blue-absorbing) dye images are formed in the red, green and blue recording layer units respectively. Subsequently the element is bleached (i.e., developed silver is converted back to silver halide) to eliminate neutral density attributable to developed silver and then fixed (i.e., silver halide is removed) to provide stability during subsequent room light handling.

Systems for processing color negative photographic elements are included among those disclosed in *Research Disclosure,* Item 38957, XVIII. Chemical development systems. Color developing agents are included among developing agents disclosed in Item 38957, XIX. Development, A. Developing Agents.

A type of color negative processing that is widely used is the Kodak Flexicolor™ color negative process. Since minor adjustments of the C-41 process are undertaken from time to time, the following detailed description is provided:

| | | | |
|---|---|---|---|
| Develop | 3'15" | Developer | 37.8° C. |
| Bleach | 4' | Bleach | 37.8° C. |
| Wash | 3' | | 35.5° C. |
| Fix | 4' | Fixer | 37.8° C. |
| Wash | 3' | | 35.5° C. |
| Rinse | 1' | Rinse | 37.8° C. |

Developer

| | |
|---|---|
| Water | 800.0 mL |
| Potassium Carbonate, anhydrous | 34.30 g |
| Potassium bicarbonate | 2.32 g |
| Sodium sulfite, anhydrous | 0.38 g |
| Sodium metabisulfite | 2.96 g |
| Potassium Iodide | 1.20 mg |
| Sodium Bromide | 1.31 g |
| Diethylenetriaminepentaacetic acid pentasodium salt (40% soln) | 8.43 g |
| Hydroxylamine sulfate | 2.41 g |
| N-(4-amino-3-methylphenyl)-N-ethyl-2-aminoethanol | 4.52 g |
| Water to make | 1.0 L |
| pH @ 26.7° C. 10.00 +/− 0.05 | |

Bleach

| | |
|---|---|
| Water | 500.0 mL |
| 1,3-Propylenediamine tetra-acetic acid | 37.4 g |
| 57% Ammonium hydroxide | 70.0 mL |
| Acetic acid | 80.0 mL |

-continued

| | |
|---|---|
| 2-Hydroxy-1,3-propylenediamine tetraacetic acid | 0.8 g |
| Ammonium Bromide | 25.0 g |
| Ferric nitrate nonahydrate | 44.85 g |
| Water to make | 1.0 L |
| pH 4.75 | |
| Fix | |
| Water | 500.0 mL |
| Ammonium Thiosulfate (58% solution) | 214.0 g |
| (Ethlenedinitrilo)tetraacetic acid disodium salt, dihydrate | 1.29 g |
| Sodium metabisulfite | 11.0 g |
| Sodium Hydroxide (50% solution) | 4.70 g |
| Water to make | 1.0 L |
| pH at 26.7° C. 6.5 +/± 0.15 | |
| Rinse | |
| Water | 900.0 mL |
| 0.5% Aqueous p-tertiary-octyl-(α-phenoxypolyethyl)alcohol | 3.0 mL |
| Water to make | 1.0 L |

When processing is conducted as noted above, negative dye images are produced. To produce a viewable positive dye image and hence to produce a visual approximation of the hues of the subject photographed, white light is typically passed through the color negative image to expose a second color photographic element having red, green and blue recording layer units as described above, usually coated on a white reflective support. The second element is commonly referred to as a color print element, and the process of exposing the color print element through the image bearing color negative element is commonly referred to as printing. Processing of the color print element as described above produces a viewable positive image that approximates that of the subject originally photographed.

Whereas color print elements are exposed using a controlled light source, a color negative element must function under a variety of lighting conditions. When light available during exposure is marginal, increased sensitivity of the color negative elements greatly increases the opportunities for capture of pleasing and superior quality photographic images.

Color negative photographic elements that employ a single red recording emulsion layer, a single green recording emulsion layer, and a single blue recording emulsion layer are commonly referred to as "single coated". It has been long recognized that an improved speed-granularity relationship can be realized in color negative elements by dividing each of the red, green and blue recording layer units into layer units differing in speed. Color negative photographic elements having layer units divided into two layer units for recording in the same region of the spectrum are commonly referred to as "double coated". Color negative photographic elements having layer units divided into three layer units for recording in the same region of the spectrum are commonly referred to as "triple coated".

Once a light recording dye image-forming layer unit is divided into two or three layer units differing in speed for recording light in the same region of the spectrum, the opportunity is created for modifying imaging performance by varying the sequence in which the layer units are coated.

A widely used triple coated color negative photographic element layer unit sequence, Type A, is illustrated by the following triple coated layer arrangement:

| Type A |
|---|
| Protective Layer Unit |
| Fast Blue Recording Layer Unit |
| Intermediate Blue Recording Layer Unit |
| Slow Blue Recording Layer Unit |
| Fast Green Recording Layer Unit |
| Intermediate Green Recording Layer Unit |
| Slow Green Recording Layer Unit |
| Fast Red Recording Layer Unit |
| Intermediate Red Recording Layer Unit |
| Slow Red Recording Layer Unit |
| Support |

The Type A layer arrangement is preserved when the intermediate speed layer units are omitted to form a double coated structure. An advantage of the Type A layer sequence is that by coating all of the blue recording layer units together, all of the green recording layer units together, and all of the red recording layer units together protection against color contamination of the layer units is simplified. For example, this allows a filter layer to be interposed between the slow blue and fast green layer units to protect all of the minus blue (green or red) recording layer units from blue light exposure without reducing blue speed. It also reduces the risk of oxidized developing agent wandering from a layer unit for recording in one spectral region to a layer unit for recording in another spectral region. Typically, two interlayers containing oxidized developing agent scavenger are provided, one located between the fast red and slow green layer units and another located between the fast green and slow blue recording layer units.

The protective layer unit protects the element physically and provides a convenient location for addenda that modify physical properties. An antihalation layer unit, not shown, but almost always included, can be interposed between the slow red recording layer unit or coated on the opposite (back) side of the support. Except for dividing each of the light-recording layer units into multiple layer units, the Type A layer sequence does not differ from that of a single coated color negative element.

A common variation of the Type A layer unit sequence is the Type B layer unit sequence, commonly referred to as the "inverted magenta" layer sequence:

| Type B |
|---|
| Protective Layer Unit |
| Fast Blue Recording Layer Unit |
| Intermediate Blue Recording Layer Unit |
| Slow Blue Recording Layer Unit |
| Fast Green Recording Layer Unit |
| Fast Red Recording Layer Unit |
| Intermediate Green Recording Layer Unit |
| Intermediate Red Recording Layer Unit |
| Slow Green Recording Layer Unit |
| Slow Red Recording Layer Unit |
| Support |

The Type B layer arrangement is preserved when the intermediate speed layer units are omitted to form a double coated structure. In the Type B arrangement the fast, intermediate and slow red recording layer units are each coated immediately below the corresponding fast, intermediate and slow green recording layer units. This improves the red exposure record and, on balance, improves the overall performance of the color photographic element. A larger number of interlayers are employed when it is undertaken to locate oxidized color developing agent scavenger between layer units that record in different regions of the spectrum to reduce color contamination. This has not, however, precluded use of the Type B layer unit arrangement. The protective and antihalation layer units are unaffected by the inverted magenta layer unit sequence. The inverted magenta layer unit sequence was first disclosed in Eeles et al U.S. Pat. No. 4,184,876 in a double coated format.

One of the advantages of Type A and Type B layer sequences is that all of the blue recording layer units are located to receive exposing radiation prior to the minus blue recording layer units. This allows a yellow filter dye to be placed in an interlayer between the blue and minus blue recording layer units to protect the latter from color contamination caused by native blue sensitivity of the minus blue recording layer units.

Over the years many alternative layer coating sequences of layer units have been mentioned, although very few have found actual use. *Research Disclosure,* Vol 389, September 1996, Item 38957, XI. Layers and layer arrangements, illustrate various alternatives.

It is a customary practice to place all of the blue recording layer units farther from the support than the green and red recording layer units. This allows a yellow filter to be placed between the blue and minus blue recording layer units, thereby protecting the latter from blue light contamination attributable to native blue sensitivity of the silver halide grains present in the minus blue recording layer units. Kofron et al U.S. Pat. No. 4,439,520 discloses alternative layer unit sequences in which green and/or red recording layer units are coated to receive exposing radiation prior to at least one of the blue recording layer units. These arrangements are disclosed by Kofron et al to be unexpectedly free of blue light contamination of minus blue color records by the lower ratio of native blue to minus blue speed of substantially optimally sensitized high aspect ratio tabular grain emulsions.

Sowinski et al U.S. Pat. No. 5,219,715 teaches that color negative photographic elements containing tabular grain emulsions with a tabularity (T) in at least one layer unit of 50 or higher and a total imaging unit thickness of less than about 4.0 $\mu$m exhibit increased sharpness and reduced color contamination. The Kodak Flexicolor™ color negative process described above is employed. Double coated Type A layer arrangements are disclosed.

SUMMARY OF THE INVENTION

In one aspect, this invention is directed to a process of developing a color negative photographic element comprised of a support having first and second major surfaces and, coated on the first major surface, a series of hydrophilic colloid layers including at least two red recording layer units containing at least one dye image-forming coupler capable of reacting with a color developing agent to produce a dye image of a first hue, at least two green recording layer units containing at least one dye image-forming coupler capable of reacting with a color developing agent to produce a dye image of a second hue, and at least two blue recording layer units containing at least one dye image-forming coupler capable of reacting with a color developing agent to produce a dye image of a third hue, wherein, the series of hydrophilic colloid layers include the following sequence, starting with the layer unit coated nearest the support: a slower speed red recording layer unit, a slower speed green recording layer unit, a slower speed blue recording layer unit, a faster speed red recording layer unit, a faster speed green recording layer unit, and a faster speed blue recording layer unit, and color development is undertaken in a time (S) ranging from 15 to 110 seconds and a development temperature (T) ranging from 40 to 65° C., development time and temperature being chosen to satisfy the relationship: (I)

$$(T)(\log S) \geqq 75.$$

It has been discovered quite unexpectedly that, when rapid processing of color negative elements of the construction described is undertaken in accordance with requirements of relationship (I) above, unexpectedly high imaging speeds are observed.

DESCRIPTION OF PREFERRED EMBODIMENTS

It has been discovered quite unexpectedly that a large speed increase can be realized when a color negative photographic element containing interleaved slower and faster red, green and blue recording layer units is processed in a color developer under the rapid access processing conditions set out by the following relationship: (I)

$$(T)(\log S) \geqq 75$$

wherein

T is a color development temperature in the range of from 40 to 65° C. and

S is a development time in the range of from 15 to 110 seconds.

It has been observed that, when color development is undertaken for 2 or more minutes in the temperature range of the invention, imaging speeds are observed that are inferior to those realized by the practice of the invention. Further, color development times of two minutes or more are disadvantageous in that they do not take advantage of the rapid processing capability of the color negative elements contemplated for use in the practice of the invention. To illustrate the departure of this invention from current commercial color development practices, it is noted that the Kodak Flexicolor™ C41 color negative process employs a color development time of 3'15".

Color development times of from 15 to 110 seconds are contemplated at a color development temperature of 65° C. As color development temperatures are reduced below 65° C., progressively higher color development times are required to realize the observed speed advantages. In all instances the present invention contemplates color development temperatures above 40° C., which is above the color development temperature of the Kodak Flexicolor™ C41 color negative process. A preferred color development temperature is at or above 45° C. At all color development temperatures of 45° C. and higher color development times of 60 to 110 seconds produce the speed advantages of the invention. At all color development temperatures of 50° C. and higher color development times of 30 to 110 seconds produce the speed advantages of the invention. Since color development times of 65° C. allow color development times as low as 15 seconds, there is little processing time reduction advantage to be gained by further increasing color development temperature. For most applications the advantages of maintaining color development temperatures at or below 60° C. are preferred to the small incremental reductions in color development time that are feasible at higher temperatures.

The following layer arrangement, hereinafter referred to as Type C, is illustrative of an interleaved triple coated layer unit construction satisfying the requirements of the invention:

| Type C |
| --- |
| Protective Layer Unit |
| Fast Blue Recording Layer Unit |
| Fast Green Recording Layer Unit |
| Fast Red Recording Layer Unit |
| Intermediate Blue Recording Layer Unit |
| Intermediate Green Recording Layer Unit |
| Intermediate Red Recording Layer Unit |
| Slow Blue Recording Layer Unit |
| Slow Green Recording Layer Unit |
| Slow Red Recording Layer Unit |
| Support |

A Type C double coated layer arrangement is created when the intermediate red, green and blue recording layer units are omitted.

When the triple coated Type C layer arrangement is compared with the triple coated Type A and Type B layer arrangements described above, some apparent disadvantages are observed that are believed to have deterred use of Type C layer arrangements for commercial color negative imaging.

First, the fast minus blue recording layer units are coated to receive exposing radiation prior to the intermediate speed and slow blue recording layer units, and the intermediate speed minus blue recording layer units are coated to receive exposing radiation prior to the slow blue recording layer unit. Thus, either the fast and intermediate speed minus blue recording layer units must receive blue light exposure or, if the customary yellow filters are employed (e.g., placed in an interlayer between the fast blue and fast green recording layer units), the blue speed of the photographic element must suffer.

The use of tabular grain emulsions, including silver iodobromide emulsions, is taught by Kofron et al, cited above, to reduce color contamination (increase minus blue and blue speed separation), but the advantages realized in the color negative elements of the invention are larger than anticipated. High chloride emulsions in the minus blue recording layer units have no significant native blue sensitivity; however, high chloride emulsions have not been widely used in color negative elements.

Another disadvantage of the Type C layer arrangement is that green acuity has been observed to be degraded. Since the human eye is most sensitive to the green portion of the spectrum, it is usually an objective to obtain the sharpest possible image for viewing in the green. In a color negative element the green exposure produces a magenta dye image which, on use as a master for exposure of a color print element, creates a green image for viewing. Loss of green acuity is, however, a disadvantage only for color negative elements intended to be employed for optical printing. When the magenta dye image information is retrieved from a Type C layer arrangement by scanning and then converted to an electronic digital image, image sharpness can be restored.

Since the recording layer units for recording in differing regions of the spectrum are interleaved, there is also a higher risk of color contamination by oxidized color developing agent migrating from one recording layer unit to the next adjacent recording layer unit. If interlayers containing oxidized developing agent scavenger are placed between each of the adjacent recording layer units, this amounts to an undesirably large number of interlayers when ease of manufacture is considered.

Again, however, this disadvantage is largely limited to color negative elements intended to be used for optical printing. It is possible to manipulate electronic digital color records retrieved from Type C layer arrangements by scanning to reduce or eliminate color contamination.

The apparent disadvantages of Type C layer arrangements, particularly for optical printing applications, have resulted in the lack of commercial interest in layer arrangements of the type contemplated by this invention for use in color negative elements intended for rapid access processing. As a result, not until the present careful investigation of Type C layer arrangements particularly adapted for rapid access processing was undertaken, did the discovery of the advantages of this invention occur. The unexpected speed advantage obtained with the combination of rapid access processing, higher color development temperatures, and Type C layer arrangements more than offset the apparent disadvantages noted above.

A preferred application for the process of the invention is in conjunction with color negative elements intended to be scanned following processing for creation from the blue, green and red color records in the color negative elements digital color records. The digital color records can be manipulated in a variety of ways while in electronic form. For example, contrast and/or maximum density can be increased. It is also possible to reduce or eliminate color contamination by manipulation of the digital color record. Color contamination resulting from migration of oxidized developing agents between adjacent recording layer units can be reduced or eliminated by manipulation of electronic digital color records retrieved by scanning. Thus, the incorporation of oxidized developing agent scavengers can be eliminated, but are preferably retained and managed as described below. Manipulation of electronic digital color records also allows masking couplers, conventionally employed in color negative elements to compensate for unwanted (e.g., outside the intended spectral region) absorptions of the dye images to be eliminated. It is also possible by manipulation of the digital color record to achieve dye image qualities normally obtained by the incorporation of dye image modifying couplers, such as development inhibitor releasing (DIR) couplers. This allows dye image modifying couplers to be omitted from the color negative elements of the invention intended to be scanned rather used for exposing a color print. Generally any portion of the red, green and blue characteristic curves lying at density levels above minimum density can be adjusted by electronic manipulation.

However, electronic manipulation of the digital color records cannot increase imaging speed. Imaging speed sets the minimum exposure threshold at which developable latent image formation occurs. Below this threshold, no useful image is formed by the color negative element. When a color negative element lacking a latent image is processed and scanned, no image is produced. Hence there is no image to be manipulated after scanning. By increasing overall imaging speeds of Type C color negative elements, the color negative processes of the invention improve on a photographic property that cannot be enhanced by digital image manipulation. Further, the speed increase is not offset by other degradations of the image eventually viewed, since lower than optimum contrast and maximum density and color contamination can all be mitigated by conventional electronic digital image adjustments. By taking advantage of conventional electronic digital image adjustments, it is possible to produce from the color negative element a viewable positive image, such as a color print, color reversal slide, or electronic image projection, that benefits from increased color negative element speed without offsetting visual penalties.

To facilitate rapid access development the total hydrophilic colloid on the side of the support containing the dye image-forming layer units is preferably limited to less than 15 g/m$^2$. When, as is preferred, the color negative elements are constructed for color record retrieval by scanning, elimination as noted above of components, such as masking couplers and dye image modifying couplers, allows thinner coatings to be realized. In addition, in color records intended to be retrieved by scanning and manipulated in electronic digital form, lower dye image maximum densities are useful, allowing lower silver coating coverages to be employed and consequently lower hydrophilic colloid coating coverages. For example, the maximum red, green and blue densities in a fully processed color negative element intended to be scanned for image information retrieval can each be less than 1.0. Thus, for color negative elements intended for scanning, the total hydrophilic colloid coating coverage noted above can be further reduced to less than 10 g/m$^2$.

The support of a color negative element according to the invention can be either transparent or reflective. While transparent supports are preferred and conventionally employed where the color negative element is employed for exposing a color print element, it is possible to employ either transmission or reflection scanning in retrieving dye image information. The advantage of reflection scanning is that the maximum dye density is doubled, since the scanning beam penetrates the layer units twice before it is intercepted by the photo-receptor. This facilitates obtaining dye image densities of at least 1, as noted above, with only half the dye image-forming compounds, silver and hydrophilic colloid coating coverages required for transmission scanning. On the other hand, where the color negative element has been constructed to maintain an optical printing capability, the support must be transparent, and, where a transparent support is present, transmission scanning is most convenient.

When reflective, the support is preferably white. When the support is transparent, it can be either colorless or tinted. Details of photographic element support construction are well understood in the art. Details of support constructions, including subbing layers to enhance adhesion, are disclosed in *Research Disclosure,* Item 38957, cited above, XV. Supports.

All of the layers coated on the support in the Type C layer arrangement described above are intended to be penetrated by processing solutions. Thus, these layers, as well as any antihalation layer (not shown), are all constructed employing hydrophilic colloid, such as gelatin or gelatin derivatives, as a vehicle. Hydrophilic colloid vehicles (including peptizers and binders) as well as vehicle extenders, such as latices, hydrophilic colloid modifiers (e.g., hardeners) as well as other related addenda are disclosed in *Research Disclosure,* Item 38957, II. Vehicles, vehicle extenders, vehicle-like addenda and vehicle related addenda. The color negative elements, as is conventional practice, are fully forehardened. This limits water ingestion during processing and facilitates rapid access processing.

Typically an antihalation layer is coated on one surface of the support, either interposed between the image dye-forming layer units and the support or coated on the back (opposite) side of the support. Useful antihalation dyes and their decolorization are illustrated by *Research Disclosure,* Item 38957, XIII. Absorbing and scattering materials, B. Absorbing materials and C. Discharge.

It is common practice to incorporate an oxidized developing agent scavenger in recording layer units or in interlayers between layer units that record exposures in different spectral regions. An oxidized developing agent scavenger is a compound that reacts with oxidized color developing agent to produce a substantially colorless compound. Oxidized developing agent scavengers are disclosed in *Research Disclosure,* Item 38957, X. Dye image formers and modifiers, D. Hue modifiers/stabilization, paragraph (2).

When the concentration of dye-forming coupler within a recording layer unit is at least stoichiometrically equal to the amount of oxidized color developing agent that can be generated (which is, in turn controlled by the silver halide coating coverage within the layer unit), there is little advantage to be gained by incorporating an oxidized developing agent scavenger, since there is a high probability of oxidized color developing agent molecules encountering dye image-forming coupler molecules within the recording layer unit. For this reason interlayers can be omitted between adjacent recording layer units intended to record exposures in different spectral regions that contain sufficient image dye-forming coupler to satisfy stoichiometric requirements.

It is common practice to "coupler starve" fast recording layer units to reduce dye image granularity, meaning simply that less than a stoichiometrically sufficient amount of image dye-forming coupler is incorporated in the fast recording layer units. Thus, migration of oxidized color developing agent from fast recording layer units is highly probable, since there is a stoichiometrically insufficient amount of image dye-forming coupler present for reaction. Hence, interlayers containing oxidized developing agent scavenger are commonly used and in the present invention preferred to separate fast recording layer units from adjacent recording layer units that record exposure in a different spectral region. There is, however, no requirement of such interlayers, since reduced granularity without coupler starvation in color negative films intended to be scanned is taught by Sutton U.S. Pat. No. 5,314,794, cited and discussed below.

If a silver halide emulsion that exhibits significant native sensitivity to the blue region of the spectrum is employed in the slow red and/or slow green recording layer unit, it is preferred, but not required, to place Carey Lea silver or a yellow filter dye in an interlayer between the slow minus blue layer unit or units exhibiting native blue sensitivity and the slow blue recording layer unit. Suitable yellow filter dyes are included among the dyes disclosed in Research Disclosure, Item 38957, cited above, VIII. Absorbing and scattering materials, B. Absorbing materials.

Any silver halide emulsion capable of forming a latent image upon exposure known to be useful in color negative photographic elements can be employed in the color negative elements of the invention. Illustrations of conventional radiation-sensitive silver halide emulsions, including both tabular and nontabular grain emulsions, are provided by *Research Disclosure,* Item 38957, I. Emulsion grains and their preparation.

In a preferred form, each of the blue, green and red recording layer units contain radiation-sensitive silver iodobromide emulsions. The grains contain at least 0.1 (preferably at least 0.5) mole percent iodide, based on silver, to increase photographic speed in relation to mean ECD and hence granularity. Higher iodide concentrations are commonly employed in arriving at non-uniform iodide distributions that make further contributions in imaging speed. However, overall iodide concentrations are commonly elevated to improve color saturation (e.g., to achieve inter-image effects). Iodide concentrations up to the saturation level of iodide ion in a silver bromide crystal lattice structure are contemplated, typically about 40 mole percent, depending upon the exact conditions of grain precipitation. It is usually preferred to limit iodide concentrations to less than 15 (most preferably<10 and optimally<5) mole percent, based on silver.

The grains of the silver iodobromide emulsions can be either regular or irregular (e.g., tabular). In the blue recording layer unit the native blue sensitivity of the AgIBr grains can be relied upon to capture exposing radiation. When a blue absorbing spectral sensitizing dye is adsorbed to the surface of the grains, blue light absorption is increased. Both tabular and nontabular grain AgIBr emulsions are commonly employed in blue recording layer units.

Tabular grain emulsions, those in which tabular grains account for at least 50 (preferably at least 70 and optimally at least 90) percent of total grain projected area are particularly advantageous for increasing speed in relation to granularity in the green or red spectrally sensitized emulsions employed in green and red recording layer units. To be considered tabular, a grain requires two major parallel faces with a ratio of its equivalent circular diameter (ECD) to its thickness of at least 2. Specifically preferred tabular grain emulsions are those having a tabular grain average aspect ratio of at least 5 and, optimally, greater than 8. Preferred mean tabular grain thicknesses are less than 0.3 $\mu$m (most preferably less than 0.2 $\mu$m). Ultrathin tabular grain emulsions, those with mean tabular grain thicknesses of less than 0.07 $\mu$m, are specifically preferred. The grains preferably form surface latent images so that they produce negative images when processed in a surface developer.

The emulsions are in all instances chemically sensitized to increase their imaging speed. Chemical sensitization, which can take any conventional form, is illustrated in section IV. Chemical sensitization. Middle chalcogen (i.e., sulfur and/or selenium) sensitization, noble metal sensitization (most typically gold sensitization), or a combination of both are most commonly employed.

The silver halide grains that are intended to record exposures in the minus blue region of the spectrum are in all instances spectrally sensitized. At least one red absorbing spectral sensitizing dye is adsorbed to the silver halide grains in the red recording layer units, and at least one green absorbing spectral sensitizing dye is adsorbed to the silver halide grains in the green recording layer units. The blue recording layer units can rely on native blue sensitivity, where the selection of halide imparts significant native sensitivity, but in most instances a blue absorbing spectral sensitizing dye is adsorbed to the surfaces of the silver halide grains, even when the grains possess significant native blue sensitivity. Spectral sensitization and sensitizing dyes, which can take any conventional form, are illustrated by *Research Disclosure,* Item 38957, section V. Spectral sensitization and desensitization.

The emulsion layers also typically include one or more antifoggants or stabilizers, which can take any conventional form, as illustrated by section VII. Antifoggants and stabilizers.

Each of the red, green and blue recording layer units contains at least one dye image-forming compound. The dye image-forming compounds in each of the red, green and blue recording layer units produce, following imagewise exposure and processing, a dye image that is distinguishable in hue from dye produced in the remaining recording layer units. Specifically, the three red recording layer units are contemplated to produce a dye image that is distinguishable in hue from dye images produced in the green recording layer units and the blue recording layer units. Similarly, green recording layer units are contemplated to produce a dye image that is distinguishable in hue from dye images produced in the red recording layer units and the blue recording layer units. When these conditions are satisfied, the blue recording layer units must, of necessity, also produce a dye image that is distinguishable in hue from dye images produced in the green and red recording layer units.

When the color negative elements are intended to be scanned, rather than being used for optical printing, it is appreciated that the dye images in the red, green and blue recording layer units can be selected from a wide range of hues, subject only to the requirement of being distinguishable upon scanning. For example, whereas, a color negative element intended to be used for creating a color print contains cyan, magenta and yellow dye images in the red, green and blue recording layer units, respectively, following imagewise exposure and processing, the red, green and blue recording layer units in color negative elements intended to be scanned can each contain any one of the cyan, magenta or yellow dye images, subject only to the requirement that no two of the red, green and blue recording layer units contain a dye image of the same hue. In fact, unlike optical printable color negative elements, elements intended to be scanned, need not be limited to cyan, magenta or yellow dyes. The dyes can absorb in the visible or beyond the visible spectrum. Near ultraviolet as well as near infrared absorbing dye images are contemplated. To simplify scanning, the image dyes in the different recording layer units preferably have half-peak absorption bandwidths that are non-overlapping.

As taught by Sutton U.S. Pat. No. 5,314,794, the disclosure of which is here incorporated by reference, it is possible to obtain superior image records by scanning when at least two of the different layer units for recording exposures in the same region of the spectrum produce dye images that are distinguishable in hue. By forming a dye image in the faster or fastest recording layer unit of a diad or triad of red, green or blue recording layer units, that is distinguishable in hue from the dye image produced by the remaining recording layer units of the diad or triad, it is possible to use the color record of the faster or fastest layer unit for creating a digital image record in regions where minimal exposure has occurred so that no dye image has been created by the slower speed recording layer unit or units of the diad or triad. Once exposure is sufficient to create a dye image (differing in hue) in a slower recording layer unit of the diad or triad, this can be used thereafter exclusively for creating a record of exposure to the same region of the spectrum. This allows the advantage to be realized of obtaining the speed of the faster or fastest recording layer unit without accepting its higher level of granularity (noise) in regions of higher exposure. In color negative elements intended to be scanned rather than used for optical printing, this technique accomplishes the same result as coupler starvation, discussed above. Producing dye images of distinguishable hues in recording layer units that record exposures to the same region of the spectrum provides an alternative to conventional coupler starvation techniques. It is, however, not incompatible with conventional coupler starvation techniques. That is, both techniques can be employed together, if desired.

Dye image-forming couplers of any convenient conventional form can be chosen for incorporation in the Type C color negative elements. Dye image-forming couplers are compounds that react with an oxidized color developing agent produced by silver halide grain development to produce an aromatic azo-methine dye. A general review of image dye-forming couplers and color developing agents is provided by James *The Theory of the Photographic Process,* 4th Ed., Macmillan, New York, 1977, Chapter 12. Principles and Chemistry of Color Photography, here incorporated by reference.

Notwithstanding the broad choices of dye image-forming couplers, it is recognized that in the majority of implementations the color negative elements of this invention will continue to follow the conventional practice of incorporating cyan dye-forming couplers in the red recording layer units, magenta dye-forming couplers in the green recording layer units, and yellow dye-forming couplers in the blue recording layer units. These choices are preferred for color negative elements intended to be used for modulating exposure of color print elements. Because of their widespread use, these choices are, absent a particular interest in variance, also the most convenient constructions for color negative elements intended to be scanned.

In one preferred form, the blue recording layer units contain at least one yellow dye-forming coupler, the green recording layer units contain at least one magenta dye-forming coupler, and the red recording layer units contain at least one cyan dye-forming coupler. Any convenient combination of conventional dye image-forming couplers can be employed. Conventional dye image-forming couplers are illustrated by *Research Disclosure,* Item 38957, cited above, X. Dye image formers and modifiers, B. Image-dye-forming couplers. Dye-forming couplers that combine with oxidized color developing agent to produce cyan colored dyes are listed in paragraph (4). Dye-forming couplers that combine with oxidized color developing agent to produce magenta colored dyes are listed in paragraph (5). Dye-forming couplers that combine with oxidized color developing agent to produce yellow colored dyes are listed in paragraph (6). Compounds that are used with dye-forming couplers to modify the dye image, which are themselves often (but not always) dye-forming couplers, are disclosed in *Research Disclosure,* Item 13857, X. Dye image formers and modifiers, C. Image dye modifiers and D. Hue modifiers/stabilization. Techniques for dispersing dye-forming couplers and image dye modifiers are disclosed in E. Dispersing dyes and dye precursors.

Since dye-forming couplers often produce image dyes that exhibit significant absorption outside the desired region of the spectrum, it is common practice to incorporate masking dyes, including colored masking couplers, in color negative films. The masking couplers are incorporated with the dye image-forming couplers in the recording layer units. Preformed masking dyes that remain invariant in hue during processing can be incorporated in the recording layer units or in any other layer that does not interfere with imagewise exposure—e.g., in the antihalation layer. Masking dyes, including colored masking couplers, are disclosed in *Research Disclosure,* Item 38957, XII. Features applicable only to color negative, particularly paragraphs (1) and (2).

As previously indicated, when Type C color negative elements are intended to be scanned to retrieve color records, the incorporation of masking couplers, dye image modifiers, and other addenda commonly used to optimize dye images when viewed, can be singly or collectively omitted. The dye image enhancement of these addenda can be achieved by modification of digital image information obtained by scanning.

The protective layer unit can take any convenient conventional form or be omitted entirely. In practice the protective layer unit provides physical protection for the dye image-forming layer units during handling and processing and provides a convenient site of introducing addenda, particularly those that modify surface properties. The protective layer unit is commonly comprised of one or two hydrophilic colloid layers that are provided for physical protection of the color negative elements during handling and processing. In a preferred form the protective layer unit is divided into a surface layer and an interlayer, the latter functioning as a spacer between the addenda in the surface layer and the adjacent recording layer unit. In another common variant form, addenda are distributed between the surface layer and the interlayer, with the latter containing addenda that are compatible with the adjacent recording layer unit. Most typically the protective layer unit contains addenda, such as coating aids, plasticizers and lubricants, antistatic agents and matting agents, such as illustrated by *Research Disclosure,* Item 38957, IX. Coating physical property modifying addenda. It is also common practice to coat an overcoat layer on the back side of the support to locate some or all of the physical property modifying addenda also adjacent to the back surface of the film. The overcoat layers overlying the emulsion layers additionally preferably contain an ultraviolet absorber, such as illustrated by *Research Disclosure,* Item 38957, VI. UV dyes/optical brighteners/luminescent dyes, paragraph (1).

A number of modifications of color negative elements have been suggested for accommodating scanning, as illustrated by *Research Disclosure,* Item 38957, XIV. Scan facilitating features. These systems to the extent compatible with the color negative element constructions described above are contemplated for use in the practice of this invention. However, many of the systems in paragraph (1), such as those that rely on unbleached silver to replace one image dye or employ reflective or fluorescent interlayers to facilitate scanning, present construction or use disadvantages that have resulted in their disuse. The features of paragraphs (2) and (3) are generally compatible with the preferred forms of the invention.

The color negative elements of the invention can be imagewise exposed in any convenient conventional manner. Although the Type C color negative elements processed according to the invention exhibit enhanced photographic speeds, these color negative elements need not be constructed to exhibit high speeds in order to offer advantages. As is explained by Kofron et al U.S. Pat. No. 4,439,520, speed advantages can, if desired, be traded for granularity reductions. Color negative films are specifically contemplated for use as camera speed films having ISO ratings of from 10 to 2000, most commonly from ISO 100 to ISO 1000. They can be color balanced for exposure under tungsten illumination, for daylight exposure or for flash exposure.

Rapid access processing as contemplated by the invention can be practiced with conventional color developer compositions and color negative processing systems. Such compositions and systems are included among those disclosed in *Research Disclosure,* Item 38957, XVIII. Chemical development systems, B. Color-specific processing systems, XIX. Development, and XX. Desilvering, washing, rinsing and stabilizing.

Following imagewise exposure photographic processing is undertaken to produce internal dye images. In one preferred form it is contemplated to modify the Kodak Flexicolor™ C-41 process described above by reducing development times and increasing development temperatures satisfying relationship (I) as described above. It is also possible to modify the developer composition to increase its activity, thereby contributing to shorter processing times. Further, it is possible to adjust dye-forming coupler concentrations and activity levels in the color negative films to allow for more rapid development.

Although the Type C color negative films are specifically contemplated for use in a shortened development step form of the Kodak Flexicolor™ C-41, demonstrated in the Examples below, it is appreciated that useful color negative images can be obtained in a wide variety of processing compositions and under a variety of processing conditions. For example, Type C color negative elements can be processed in 110 seconds or less in similarly modified commercial color negative processes, such as the Kodacolor C-22™ process, the Agfacolor processes described in *British Journal of Photography Annual,* 1977, pp. 201–205, and 1988, pp. 196–198, Kodak motion picture processes ECN-2, ECN-2*a* and ECN-2*b*.

In color negative processing the first and only absolutely essential step for creating the internal dye images sought is the step of color development. Color development requires at least one color developing agent. These typically take the form of an aromatic ring, such as benzene, substituted with one or two primary amines. They include aminophenols and p-phenylenediamines, especially N,N-dialkyl-p-phenylenediamines. The alkyl moieties can be substituted or unsubstituted and typically each contain from 1 to 6 carbon atoms, inclusive of substituents. As illustrated by James, cited above, p. 353, structure (1),p-phenylenediamines commonly have a substituent ortho to the primary amine substituent to modify the solubility of the color developing agent and the absorption wavelength of the image dye produced on coupling. Table 12.6, page 354, of James shows the effect of varied p-phenylenediamine substituents on image dye maximum absorption wavelengths ($\lambda$max).

Examples of specific aminophenol developing agents include o-aminophenol, p-aminophenol, 5-amino-2-hydroxytoluene, 2-amino-3-hydroxytoluene, and 2-hydroxy-3-amino-1,4-dimethylbenzene. Examples of specific p-phenylenediamine color developing agents include: N,N-diethyl-p-phenylenediamonohydrochloride, 4-N,N-diethyl-2-methylphenylenediamine monohydrochloride, 4-(N-ethyl)-N-2-methanesulfonylaminoethyl)-2methylphenylenediamine sesquisulfate monohydrate and 4-(N-ethyl-N-2hydroxyethyl)-2-methylphenylenediamine sulfate.

Generally, the amount of color developing agent in the color developer is from about 0.01 to about 0.1 mole/liter, with from about 0.02 to 0.06 mole/liter being preferred.

In addition to color developing agent the developer can also include one or more of a variety of other addenda which are commonly used in such solutions, including alkali metal halides (such as potassium chloride, potassium bromide, sodium bromide and sodium iodide), metal sequestering agents (such as polycarboxylic or aminopolycarboxylic acids or polyphosphonates), other preservatives (such as sulfites, alcoholamines, amino acids and polysaccharides), antifoggants, development accelerators, optical brighteners, wetting agents, stain reducing agents, surfactants, and defoaming agents. Such addenda are illustrated by *Research Disclosure,* Item 38957, XIX. Development, and Koboshi et al U.S. Pat. No. 4,814,260, here incorporated by reference. Conventional amounts of such developer additives can be employed. For example, the amounts of halides can be varied widely, but are generally at least about $5\times10^{-5}$ to about 0.4 mol/liter for bromide ion and at least about $5\times10^{-7}$ and up to about 0.01 mol/liter for iodide ion. The incorporation of chloride ion in the developer solution is optional, since chloride ion essentially has no effect on performance. Thus, generally, chloride ion is not added or present, but if it is, it is not detrimental to the invention. The incorporation of bromide and iodide ions in the color developer can be beneficial.

Color developing compositions are employed in the form of aqueous alkaline working solutions having a pH of above 7 and typically in the range of from 9 to 13. To provide the necessary pH, the solutions contain one or more of the well known and widely used buffering agents, such as the alkali metal carbonates or phosphates. Potassium carbonate is especially useful as a buffering agent for color developing compositions.

Once the dye images are obtained by development it is conventional practice to reconvert developed silver to silver halide by bleaching and then to remove the silver halide by fixing. Removal of the silver image removes the neutral silver density that is superimposed on the image dye density thereby constituting a hindrance to printing or scanning. Removal of the silver halide by fixing is undertaken to allow the developed color negative element to be handled in room light without printout (that is, without reduction of the remaining silver halide to silver) which objectionably increases minimum densities of each of the dye images. Bleaching and fixing can both be accomplished in a single bleach-fix (a.k.a., blix) solution, if desired. It is common practice to use a stop bath, such as dilute acetic acid, to lower pH and terminate color development. Usually washing or rinsing steps are conducted between development and bleaching and, where separate bleach and fix solutions are employed, between the bleaching and fixing step. A washing step is also commonly used after fixing.

*Research Disclosure,* Item 38957, XX. Desilvering, washing, rinsing and stabilizing, discloses bleaching solutions, fixing solutions, bleach-fixing solutions, and washing, rinsing and stabilizing solutions that can be used in the photographic processing of the invention.

EXAMPLES

The invention can be better appreciated by reference to the following specific embodiments.

Type A Layer Arrangement
(comparative color negative element)

| | |
|---|---|
| Overcoat Layer | Matte Beads<br>UV Absorber UV-7 (0.108) & S-9 (0.108)<br>UV Absorber UV-8 (0.108) & S-9 (0.108)<br>Silver Bromide Lippmann Emulsion (0.215)<br>Gelatin (0.70)<br>Bis(vinylsulfonyl)methane Hardener (at 1.8% by weight of total gelatin) |
| Fast Yellow Layer | Y-15 (0.108) & S-2 (0.108)<br>Blue Sensitized Silver Iodobromide Emulsion (0.592 Ag)<br>4.1 mole % Iodide T-Grain ™ (ECD 2.6 $\mu$m, t 0.134 $\mu$m)<br>Gelatin (0.97) |
| Slow Yellow Layer | Y-15 (0.430) & S-2 (0.430)<br>Blue Sensitized Silver Iodobromide Emulsion (0.108 Ag)<br>4.1 mole % Iodide T-Grain ™ (ECD 1.3 $\mu$m, t 0.13 $\mu$m)<br>Blue Sensitized Silver Iodobromide Emulsion (0.108 Ag)<br>1.5 mole % Iodide T-Grain ™ (ECD 1.0 $\mu$m, t 0.13 $\mu$m)<br>Blue Sensitized Silver Iodobromide Emulsion (0.108 Ag)<br>1.3 mole % Iodide T-Grain ™ (ECD 0.54 $\mu$m, t 0.84 $\mu$m)<br>Gelatin (1.95) |
| Interlayer | Dye-4 Filter Dye (0.108)<br>ST-4 (0.086) & S-2 (0.139)<br>Gelatin (0.646) |

-continued

| | |
|---|---|
| Fast Magenta Layer | M-5 (0.032) Magenta Dye Forming Coupler & S-1 (0.026) & ST-5 (0.006) Addendum<br>Green Sensitized Silver Iodobromide Emulsion (0.484 Ag)<br>4.1 mole % Iodide T-Grain ™ (ECD 1.25 μm, t 0.12 μm)<br>Gelatin (0.742) |
| Mid Magenta Layer | M-5 (0.161) & S-1 (0.129) & ST-5 Addendum (0.032)<br>Green Sensitized Silver Iodobromide Emulsion (0.699 Ag)<br>4.1 mole % Iodide T-Grain ™ (ECD 1.05 μm, t 0.115 μm)<br>Gelatin (0.850) |
| Slow Magenta Layer | M-5 (0.377) & S-1 (0.301) & ST-5 Addendum (0.076)<br>Green Sensitized Silver Iodobromide Emulsion (0.161 Ag)<br>2.6 mole % Iodide T-Grain ™ (ECD 0.75 μm, t 0.115 μm)<br>Green Sensitized Silver Iodobromide Emulsion (0.054 Ag)<br>1.3 mole % Iodide T-Grain ™ (ECD 0.54 μm, t 0.084 μm)<br>Gelatin (0.990) |
| Interlayer | ST-4 Oxidized Developer Scavenger (0.075) & S-2 (0.122)<br>Gelatin (0.430) |
| Fast Cyan Layer | C-12 (0.538) Cyan Dye-Forming Coupler & S-2 (0.538)<br>Red Sensitized Silver Iodobromide Emulsion (0.430 Ag)<br>4.1 mole % Iodide T-Grain ™ (ECD 1.25 μm, t 0.12 μm)<br>Gelatin (0.807) |
| Mid Cyan Layer | C-2 (0.753) & S-2 (0.753)<br>Red Sensitized Silver Iodobromide Emulsion (0.968 Ag)<br>4.1 mole % Iodide T-Grain ™ (ECD 1.05, t 0.115 μm)<br>Gelatin (1.12) |
| Slow Cyan Layer | C-2 (0.968) & S-2 (0.968)<br>Red Sensitized Silver Iodobromide Emulsion (1.614 Ag)<br>4.1 mole % Iodide T-Grain ™ (ECD 0.73, t 0.12 μm)<br>Red Sensitized Silver Iodobromide Emulsion (1.506 Ag)<br>1.3 mole % Iodide T-Grain ™ (ECD 0.54, t 0.084 μm)<br>Gelatin (1.36) |
| Antihalation Layer | Grey Silver (0.151 Ag)<br>Dye-7 (0.011)<br>Dye-5 (0.047)<br>Dye-6 (0.092)<br>ST-4 (0.108) & S-2 (0.172)<br>UV-7 (0.075) & S-9 (0.075)<br>UV-8 (0.075) & S-9 (0.075)<br>Gelatin (1.61) |

Cellulose Triacetate Support
Type B Layer Arrangement
(comparative color negative element)

| | |
|---|---|
| Overcoat Layer | Matte Beads<br>UV Absorber UV-7 (0.108) & S-9 (0.109)<br>UV Absorber UV-8 (0.108) & S-9 (0.109)<br>Silver Bromide Lippman Emulsion (0.215)<br>Gelatin (0.699)<br>Bis(vinylsulfonyl)methane Hardener (at 1.8% by weight of total Gelatin) |
| Fast Yellow Layer | Y-15 (0.183) & S-2 (0.183)<br>Blue Sensitized Silver Iodobromide Emulsion (0.592 Ag)<br>4.1 mole % Iodide T-Grain ™ (ECD 2.6 μm, t 0.134 μm)<br>Gelatin (1.36) |

-continued

| | |
|---|---|
| Slow Yellow Layer | Y-15 (0.473) & S-2 (0.473)<br>Blue Sensitized Silver Iodobromide Emulsion (0.161 Ag)<br>4.1 mole % Iodide T-Grain ™ (ECD 1.3 μm, t 0.13 μm)<br>Blue Sensitized Silver Iodobromide Emulsion (0.248 Ag)<br>1.5 mole % Iodide T-Grain ™ (ECD 1.0 μm, t 0.13 μm)<br>Blue Sensitized Silver Iodobromide Emulsion (0.172 Ag)<br>1.3 mole % Iodide T-Grain ™ (ECD 0.54 μm, t 0.84 μm)<br>Gelatin (1.95) |
| Interlayer | Dye-4 Filter Dye (0.108)<br>ST-4 (0.086) & S-2 (0.139)<br>Gelatin (0.646) |
| Fast Magenta Layer | M-5 (0.065) Magenta Dye Forming Coupler & S-1 (0.052) & ST-5 (0.013) Addendum<br>Green Sensitized Silver Iodobromide Emulsion (0.484 Ag)<br>4.1 mole % Iodide T-Grain ™ (ECD 1.25 μm, t 0.12 μm)<br>Gelatin (0.742) |
| Interlayer | ST-4 Oxidized Developer Scavenger (0.075) & S-2 (0.122)<br>Gelatin (0.430) |
| Fast Cyan Layer | C-12 (0.215) Cyan Dye Forming Coupler & S-2 (0.215)<br>Red Sensitized Silver Iodobromide Emulsion (0.430 Ag)<br>4.1 mole % Iodide T-Grain ™ (ECD 1.25 μm, t 0.12 μm)<br>Gelatin (0.807) |
| Interlayer | ST-4 Oxidized Developer Scavenger (0.075) & S-2 (0.122)<br>Gelatin (0.430) |
| Slow Magenta Layer | M-5 (0.323) & S-1 (0.258) & ST-5 Addendum (0.065)<br>Green Sensitized Silver Iodobromide Emulsion (0.323 Ag)<br>4.1 mole % Iodide T-Grain ™ (ECD 1.16 μm, t 0.114 μm)<br>Green Sensitized Silver Iodobromide Emulsion (0.484 Ag)<br>2.6 mole % Iodide T-Grain ™ (ECD 0.81, t 0.12 μm)<br>Gelatin (0.850) |
| Interlayer | ST-4 Oxidized Developer Scavenger (0.075) & S-2 (0.122)<br>Gelatin (0.430) |
| Slow Cyan Layer | C-2 (1.076) & S-2 (1.076)<br>Red Sensitized Silver Iodobromide Emulsion (1.722 Ag)<br>4.1 mole % Iodide T-Grain ™ (ECD 1.19 μm, t 0.114 μm)<br>Red Sensitized Silver Iodobromide Emulsion (1.076 Ag)<br>1.3 mole % Iodide T-Grain ™ (ECD 0.54 μm, t 0.084 μm)<br>Gelatin (1.12) |
| Antihalation Layer | Grey Silver (0.151 Ag)<br>Dye-7 (0.011)<br>Dye-5 (0.047)<br>Dye-6 (0.092)<br>ST-4 (0.108) & S-2 (0.172)<br>UV-7 (0.075) & S-9 (0.075)<br>UV-8 (0.075) & S-9 (0.075)<br>Gelatin (1.61) |

Cellulose Triacetate Support
Type C Layer Arrangement
(example color negative element)

| | |
|---|---|
| Overcoat Layer | Matte Beads<br>UV Absorber UV-7 (0.108) & S-9 (0.109)<br>UV Absorber UV-8 (0.108) & S-9 (0.109)<br>Silver Bromide Lippman Emulsion (0.215)<br>Gelatin (0.699)<br>Bis(vinylsulfonyl)methane Hardener (at 1.8% by |

-continued

| | |
|---|---|
| | weight of total Gelatin) |
| Fast Yellow Layer | Y-15 (0.183) & S-2 (0.183)<br>Blue Sensitized Silver Iodobromide Emulsion (0.592 Ag)<br>4.1 mole % Iodide T-Grain ™ (ECD 2.6 μm, t 0.134 μm)<br>Gelatin (1.36) |
| Interlayer | ST-4 Oxidized Developer Scavenger (0.075) & S-2 (0.122)<br>Gelatin (0.430) |
| Fast Magenta Layer | M-5 (0.118) Magenta Dye Forming Coupler & S-1 (0.095) & ST-5 (0.023) Addendum<br>Green Sensitized Silver Iodobromide Emulsion (0.484 Ag)<br>4.1 mole % Iodide T-Grain ™ (ECD 1.25 μm, t 0.12 μm)<br>Gelatin (0.742) |
| Interlayer | ST-4 Oxidized Developer Scavenger (0.075) & S-2 (0.122)<br>Gelatin (0.430) |
| Fast Cyan Layer | C-12 (0.323) Cyan Dye Forming Coupler & S-2 (0.323)<br>Red Sensitized Silver Iodobromide Emulsion (0.430 Ag)<br>4.1 mole % Iodide T-Grain ™ (ECD 1.25 μm, t 0.12 μm)<br>Gelatin (0.807) |
| Interlayer | ST-4 Oxidized Developer Scavenger (0.075) & S-2 (0.122)<br>Gelatin (0.430) |
| Slow Yellow Layer | Y-15 (0.377) & S-2 (0.377)<br>Blue Sensitized Silver Iodobromide Emulsion (0.753 Ag)<br>4.1 mole % Iodide T-Grain ™ (ECD 1.3 μm, t 0.13 μm)<br>Blue Sensitized Silver Iodobromide Emulsion (0.538 Ag)<br>1.5 mole % Iodide T-Grain ™ (ECD 1.0 μm, t 0.13 μm)<br>Blue Sensitized Silver Iodobromide Emulsion (0.269 Ag)<br>1.3 mole % Iodide T-Grain ™ (ECD 0.54 μm, t 0.84 μm)<br>Gelatin (1.95) |
| Interlayer | Dye-4 Filter Dye (0.108)<br>ST-4 (0.086) & S-2 (0.139)<br>Gelatin (0.430) |
| Slow Magenta Layer | M-5 (0.355) Magenta Dye Forming Coupler & S-1 (0.284) & ST-5 (0.071) Addendum<br>Green Sensitized Silver Iodobromide Emulsion (0.226 Ag)<br>4.1 mole % Iodide T-Grain ™ (ECD 1.16 μm, t 0.114 μm)<br>Green Sensitized Silver Iodobromide Emulsion (0.624 Ag)<br>1.5 mole % Iodide T-Grain ™ (ECD 0.69 μm, t 0.117 μm)<br>Gelatin (0.850) |
| Interlayer | ST-4 Oxidized Developer Scavenger (0.075) & S-2 (0.122)<br>Gelatin (0.430) |
| Slow Cyan Layer | C-12 (1.184) Cyan Dye Forming Coupler & S-2 (1.184)<br>Red Sensitized Silver Iodobromide Emulsion (1.184 Ag)<br>4.1 mole % Iodide T-Grain ™ (ECD 1.19 μm, t 0.115 μm)<br>Red Sensitized Silver Iodobromide Emulsion (1.399 Ag)<br>4.1 mole % Iodide T-Grain ™ (ECD 0.54 μm, t 0.084 μm)<br>Gelatin (1.12) |
| Antihalation Layer | Grey Silver (0.151 Ag)<br>Dye-7 (0.011)<br>Dye-5 (0.047)<br>Dye-6 (0.092)<br>ST-4 (0.108) & S-2 (0.172)<br>UV-7 (0.075) & S-9 (0.075)<br>UV-8 (0.075) & S-9 (0.075)<br>Gelatin (1.61) |

-continued

Cellulose Triacetate Support
Type C' Layer Arrangement
(example color negative element, varied addenda)

| | |
|---|---|
| Overcoat Layer | Matte Beads<br>UV Absorber UV-7 (0.108) & S-9 (0.109)<br>UV Absorber UV-8 (0.108) & S-9 (0.109)<br>Silver Bromide Lippman Emulsion (0.215)<br>Gelatin (0.699)<br>Bis(vinylsulfonyl)methane Hardener (at 1.8% by weight of total Gelatin) |
| Fast Yellow Layer | Y-15 (0.183) & S-2 (0.183)<br>D-9 (0.0108) DIR & S-2 (0.022)<br>Blue Sensitized Silver Iodobromide Emulsion (0.592 Ag)<br>4.1 mole % Iodide T-Grain ™ (ECD 2.6 μm, t 0.134 μm)<br>Gelatin (1.36) |
| Interlayer | ST-4 Oxidized Developer Scavenger (0.075) & S-2 (0.122)<br>Gelatin (0.430) |
| Fast Magenta Layer | M-5 (0.118) Magenta Dye Forming Coupler & S-1 (0.095) & ST-5 (0.023) Addendum, D-1 (0.015) DIR & S-1 (0.030)<br>Green Sensitized Silver Iodobromide Emulsion (0.484 Ag)<br>4.1 mole % Iodide T-Grain ™ (ECD 1.25 μm, t 0.12 μm)<br>Gelatin (0.742) |
| Interlayer | ST-4 Oxidized Developer Scavenger (0.075) & S-2 (0.122)<br>Gelatin (0.430) |
| Fast Cyan Layer | C-12 (0.430) Cyan Dye Forming Coupler & S-2 (0.430), D-10 (0.015) DIR & S-1 (0.060)<br>C-2 (0.0108) Cyan Dye Forming Coupler & D-5 (0.0108) DIR & S-1 (0.043)<br>Red Sensitized Silver Iodobromide Emulsion (0.430 Ag)<br>4.1 mole % Iodide T-Grain ™ (ECD 1.25 μm, t 0.12 μm)<br>Gelatin (0.807) |
| Interlayer | ST-4 Oxidized Developer Scavenger (0.075) & S-2 (0.122)<br>Gelatin (0.430) |
| Slow Yellow Layer | Y-15 (0.377) & S-2 (0.377),<br>D-9 (0.0108) DIR & S-2 (0.022)<br>Blue Sensitized Silver Iodobromide Emulsion (0.753 Ag)<br>4.1 mole % Iodide T-Grain ™ (ECD 1.3 μm, t 0.13 μm)<br>Blue Sensitized Silver Iodobromide Emulsion (0.538 Ag)<br>1.5 mole % Iodide T-Grain ™ (ECD 1.0 μm, t 0.13 μm)<br>Blue Sensitized Silver Iodobromide Emulsion (0.269 Ag)<br>1.3 mole % Iodide T-Grain ™ (ECD 0.54 μm, t 0.84 μm)<br>Gelatin (1.95) |
| Interlayer | Dye-4 Filter Dye (0.108)<br>ST-4 (0.086) & S-2 (0.139)<br>Gelatin (0.430) |
| Slow Magenta Layer | M-5 (0.355) Magenta Dye Forming Coupler & S-1 (0.284) & ST-5 (0.071) Addendum, D-1 (0.0108) DIR & S-1 (0.022)<br>Green Sensitized Silver Iodobromide Emulsion (0.484 Ag)<br>4.1 mole % Iodide T-Grain ™ (ECD 1.16 μm, t 0.114 μm)<br>Green Sensitized Silver Iodobromide Emulsion (0.624 Ag)<br>1.5 mole % Iodide T-Grain ™ (ECD 0.69 μm, t 0.117 μm)<br>Gelatin (0.850) |

-continued

| | |
|---|---|
| Interlayer | ST-4 Oxidized Developer Scavenger (0.075) & S-2 (0.122)<br>Gelatin (0.430) |
| Slow Cyan Layer | C-2 (0.968) Cyan Dye Forming Coupler & S-2 (0.968),<br>D-10 (0.0108) DIR & S-1 (0.043)<br>Red Sensitized Silver Iodobromide Emulsion (1.399 Ag)<br>4.1 mole % Iodide T-Grain ™ (ECD 1.19 μm, t 0.115 μm)<br>Red Sensitized Silver Iodobromide Emulsion (1.076 Ag)<br>4.1 mole % Iodide T-Grain ™ (ECD 0.54 μm, t 0.084 μm)<br>Gelatin (1.12) |
| Antihalation Layer | Grey Silver (0.151 Ag)<br>Dye-7 (0.011)<br>Dye-5 (0.047)<br>Dye-6 (0.092)<br>ST-4 (0.108) & S-2 (0.172)<br>UV-7 (0.075) & S-9 (0.075)<br>UV-8 (0.075) & S-9 (0.075)<br>Gelatin (1.61) |

Cellulose Triacetate Support

Sensitometric Comparison

The Type A, Type B and Type C color negative elements were each exposed through a step tablet on an Eastman 1B™ sensitometer and processed through the KODAK FLEXICOLOR™ C-41 color negative process, previously described, but with processing times and temperatures for each step chosen as indicated in Table I.

TABLE I

| Solution | Agitation | Processing Time | Temperature |
|---|---|---|---|
| FLEXICOLOR Developer | Nitrogen Burst | 20" | 60.0° C. |
| Fresh Bleach II | Continuous Air | 4' | 37.8° C. |
| Wash | Continuous Air | 3' | 37.8° C. |
| FLEXICOLOR Fix | Continuous Air | 4' | 37.8° C. |
| Wash | Continuous Air | 3' | 37.8° C. |
| PHOTO-FLO | None | 1' | 37.8° C. |

The Status M densities of the processed films were then measured via a densitometer and density vs log exposure curves were plotted and measured. The red and green inertial speeds were measured at densities=Dmin +0.15. These inertial speeds were used to calculate the ISO speed of each film via the equation described in ISO standard 5800. The red and green gammas were measured via a least squares fit to the sensitometric curves. The speeds and gammas for the Type A, B and C color negative elements in their respective processes are compared in Table II:

TABLE II

| Film | TOD* | Speed Red | Speed Green | Speed Blue | ISO | Gamma Red | Gamma Green | Gamma Blue |
|---|---|---|---|---|---|---|---|---|
| A | 20" | 273 | 331 | 360 | 149 | 0.30 | 0.54 | 0.67 |
| B | 20" | 314 | 335 | 358 | 247 | 0.31 | 0.51 | 0.70 |
| C | 20" | 340 | 362 | 362 | 458 | 0.33 | 0.52 | 0.63 |
| C' | 20" | 331 | 366 | 368 | 368 | 0.34 | 0.56 | 0.64 |

*TOD = Time of Development

Table II indicates that the color negative elements Type A, B and C (and C') have gammas within 10% of each other, and that Type B shows the expected red speed increase over Type A due to the movement of the fast red recording layer under the fast green recording layer.

However, the Type C and C' color negative elements unexpectedly show significant green and red speed increases which result in approximately an improvement of +309 in ISO speed for Type C as compared to Type A. The inhibiting effect of the inclusion of DIR compounds in the Type C' element accounts for its slightly lower speed advantage as compared to the Type C element.

Time and Temperature of Color Development

Although Type C color negative elements in all instances exhibited superior ISO speeds to Type A color negative elements, when the Types A and C elements were processed at varied times and temperatures of color development, the ISO speed advantage of the Type C color negative elements was surprisingly large when relationship (I) was satisfied.

This is demonstrated by a repeat of the sensitometric testing reported above using the Type A and Type C color negative elements and varying the time and temperature of color development as indicated. From Table III, it is apparent that, when relationship (I) was satisfied, the ISO speed advantage of the Type C color negative element was exceptionally large.

Relationship (I):

$$(T)(\log S) \geqq 75$$

T=color development temperature in ° C. and
S=development time in seconds.

TABLE III

| Type | S | T | Rel. (I) | ISO | ΔISO |
|---|---|---|---|---|---|
| A | 20 | 60 | 88.2 | 149 | — |
| C | 20 | 60 | 88.2 | 458 | +309 |
| A | 25 | 54.4 | 81.6 | 126 | — |
| C | 25 | 54.4 | 81.6 | 358 | +232 |
| A | 20 | 48.9 | 71.9 | 24 | — |
| C | 20 | 48.9 | 71.9 | 60 | +36 |
| A | 40 | 43.3 | 69.3 | 69 | — |
| C | 40 | 43.3 | 69.3 | 129 | +60 |
| A | 40 | 48.9 | 78.2 | 214 | — |
| C | 40 | 48.9 | 78.2 | 470 | +256 |
| A | 60 | 43.3 | 76.9 | 225 | — |
| C | 60 | 43.3 | 76.9 | 441 | +216 |
| A | 70 | 48.9 | 90.3 | 464 | — |
| C | 70 | 48.9 | 90.3 | 770 | +306 |
| A | 90 | 37.8 | 73.9 | 202 | — |
| C | 90 | 37.8 | 73.9 | 373 | +171 |
| A | 100 | 48.9 | 97.8 | 615 | — |
| C | 100 | 48.9 | 97.8 | 872 | +257 |
| A | 120 | 37.8 | 78.6 | 282 | — |
| C | 120 | 37.8 | 78.6 | 435 | +153 |
| A | 120 | 48.9 | 101.7 | 575 | — |
| C | 120 | 48.9 | 101.7 | 726 | +151 |

In each of the rows with a boldface entry, the ISO speed advantage for the Type C layer arrangement was significantly smaller than in the remaining rows. These failures correlate with relationship (I) through color development temperatures until the 120° C. color development temperature level is reached. At this high temperature, the performance advantage is clearly lower. Thus, the present invention contemplates limiting the maximum temperature of color development to 110° C.

Glossary of Acronyms
S-1 = Tritolyl phosphate
S-2 = Dibutyl phthalate
S-9 = 1,4-Cyclohexyldimethylene bis(2-ethylhexanoate)
UV-7
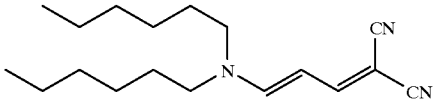
UV-8
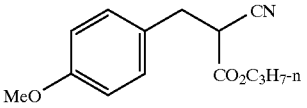
Y-15
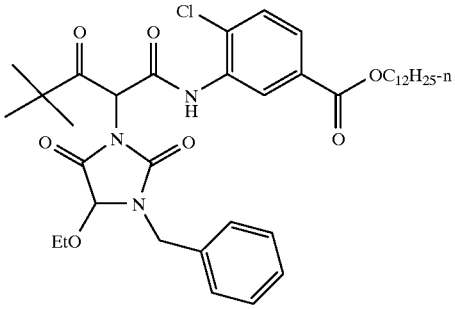
DYE 4
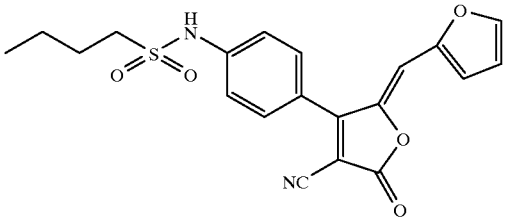
DYE 5
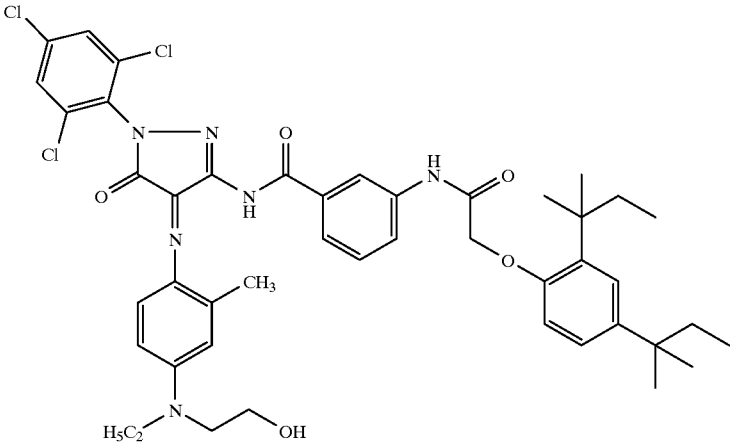

-continued
DYE 6
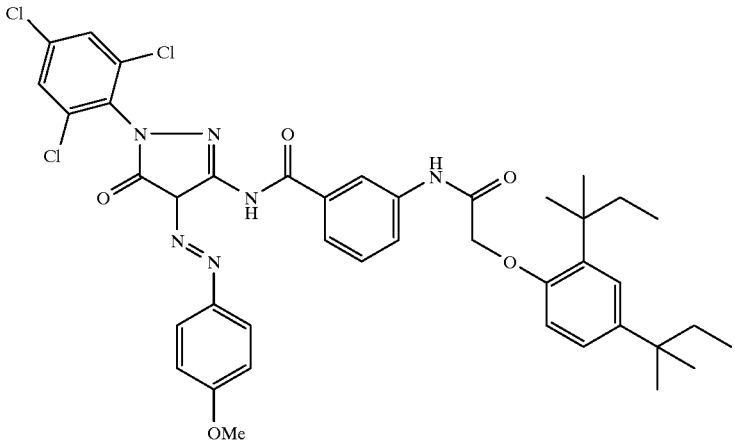
DYE 7
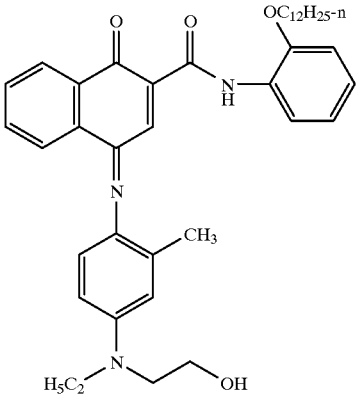
C-2
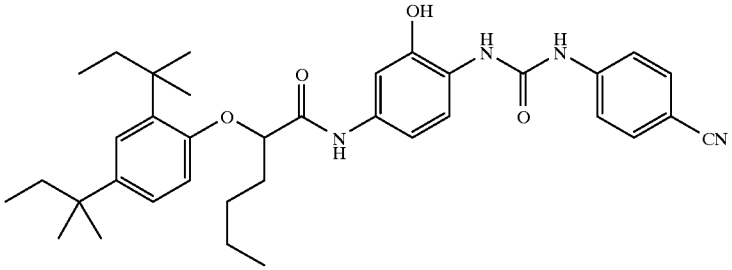
C-12
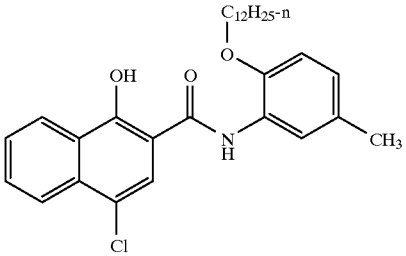
ST-4
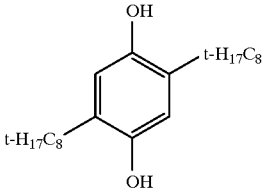

-continued
ST-5
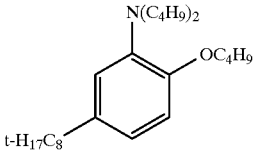
M-5
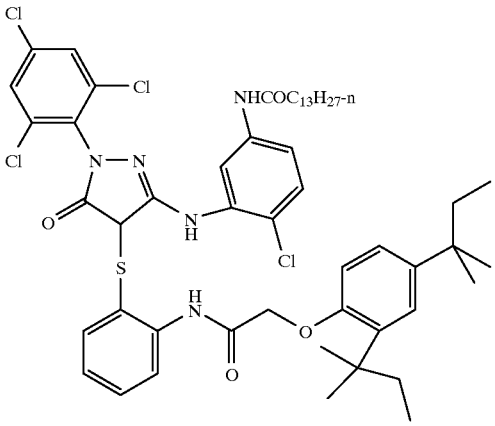
D-1
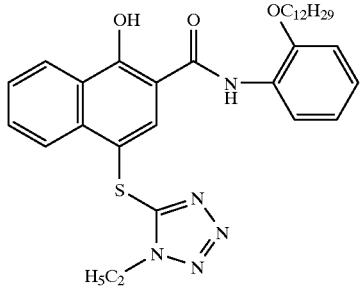
D-9
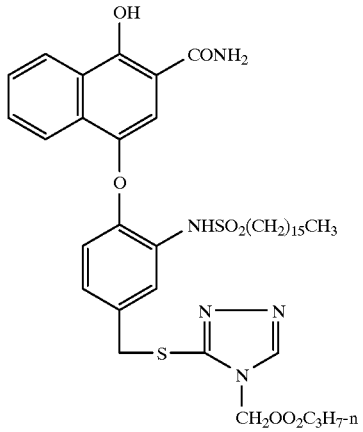

-continued

D-10

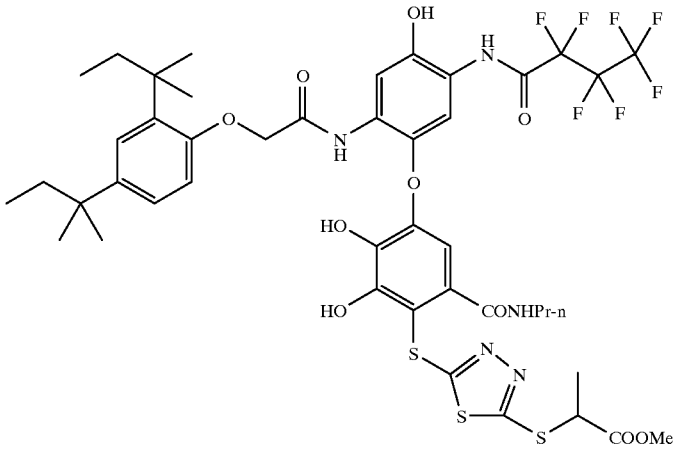

The invention has been described in detail with particular reference to preferred embodiments thereof, but it will be understood that variations and modifications can be effected within the spirit and scope of the invention.

What is claimed is:

1. A process of developing a color negative photographic element comprised of a support having first and second major surfaces and, coated on the first major surface, a series of hydrophilic colloid layers including at least two red recording layer units containing at least one dye image-forming coupler capable of reacting with a color developing agent to produce a dye image of a first hue, at least two green recording layer units containing at least one dye image-forming coupler capable of reacting with a color developing agent to produce a dye image of a second hue, and at least two blue recording layer units containing at least one dye image-forming coupler capable of reacting with a color developing agent to produce a dye image of a third hue, WHEREIN, the series of hydrophilic colloid layers include the following sequence, starting with the layer unit coated nearest the support:

a slower speed red recording layer unit, a slower speed green recording layer unit, a slower speed blue recording layer unit, a faster speed red recording layer unit, a faster speed green recording layer unit, and a faster speed blue recording layer unit, and color development is undertaken in a time (S) ranging from 15 to 110 seconds and a development temperature (T) ranging from 40 to 65° C., development time and temperature being chosen to satisfy the relationship:

$$(T)(\log S) \geqq 75.$$

2. A process according to claim 1 wherein the total hydrophilic colloid on the first major surface of the support is less than 15 $g/m^2$.

3. A process according to claim 2 wherein the total hydrophilic colloid on the first major surface of the support less than 10 $g/m^2$.

4. A process according to claim 1 wherein color development is undertaken at a temperature in the range of from 45 to 60° C.

5. A process according to claim 4 wherein color development is undertaken for a time period of 60 to 110 seconds.

6. A process according to claim 1 wherein color development is undertaken at a temperature of from 50 to 65° C. for a time period of 30 to 110 seconds.

7. A process according to claim 1 wherein the series of hydrophilic colloid layers coated on the first major surface additionally includes coated over the faster speed blue recording layer unit in the order recited a fastest red recording layer unit, a fastest green recording layer unit, and a fastest blue recording layer unit.

8. A process according to claim 1 wherein the series of hydrophilic colloid layers contains only two of each of the red, green and blue recording layer units.

9. A process according to claim 1 wherein, to facilitate scanning, masking couplers are absent.

10. A process according to claim 1 wherein, to facilitate scanning, development inhibitor releasing couplers are absent.

11. A process according to claim 1 wherein the red and green recording layer units each contain tabular grain silver halide emulsions.

12. A process according to claim 1 wherein tabular grains in the tabular grain emulsions have a mean thickness of less than 0.2 $\mu$m.

* * * * *